United States Patent [19]

Katoh

[11] Patent Number: 4,616,765

[45] Date of Patent: Oct. 14, 1986

[54] HINGE STRUCTURE WITH TORSION BAR FOR ELECTROPHOTOGRAPHIC COPYING MACHINE

[75] Inventor: Tutomu Katoh, Yamatokoriyama, Japan

[73] Assignee: Sharp Kabushiki Kaisha, Osaka, Japan

[21] Appl. No.: 785,216

[22] Filed: Oct. 7, 1985

[30] Foreign Application Priority Data

Oct. 12, 1984 [JP] Japan ..... 59-155582[U]

[51] Int. Cl.[4] ..... B65D 43/24

[52] U.S. Cl. ..... 220/335; 220/264; 355/75; 355/25

[58] Field of Search ..... 220/334, 335, 264, 259; 355/25, 75

[56] References Cited

U.S. PATENT DOCUMENTS 4,097,145 6/1978 Luperti et al. ..... 220/335

4,456,141 6/1984 Pamment ..... 220/335

*Primary Examiner*—George T. Hall

*Attorney, Agent, or Firm*—Birch, Stewart, Kolasch & Birch

[57] ABSTRACT

An electrophotographic copying machine comprises an upper body, a lower body, a torsion bar for lifting the first body upward, and a spacer for controlling the stressing force of the torsion bar. The spacer, preferably, a wedge is forced between a crank and a crank stopper of the torsion bar. A thumbscrew is further provided for controlling to force the spacer between the crank and the crank stopper.

5 Claims, 3 Drawing Figures

HINGE STRUCTURE WITH TORSION BAR FOR ELECTROPHOTOGRAPHIC COPYING MACHINE

BACKGROUND OF THE INVENTION

The present invention relates to an electrophotographic copying machine and, more particularly, to a hinge structure using a torsion bar of an electrophotographic copying machine in which a hinge can be stressed by the torsion moment of the torsion bar toward a predetermined direction to fascilitate the opening and closing of an object connected with the hinge.

A type of electrophotographic copying machine is proposed which includes a housing separated into an upper body and a lower body as disclosed, for example, in Itoh et al U.S. Pat. No. 4,416,536, issued on Nov. 22, 1983, entitled LIGHT MEMORY REMOVING SYSTEM IN AN ELECTROPHOTOGRAPHIC COPYING MACHINE. A stable and suitable hinge structure for such a type of copying machine has not yet been proposed.

SUMMARY OF THE INVENTION

Accordingly, it is an object of the present invention to provide an improved electrophotographic copying machine comprising a stable hinge structure for opening and closing the body of the copying machine.

It is another object of the present invention to provide an improved electrophotographic copying machine comprising a stable hinge structure using a torsion bar for smooth opening and closing the body of the copying machine.

It is a further object of the present invention to provide an improved electrophotographic copying machine comprising a smooth hinge structure in which a spacer member is inserted between a crank portion of the torsion bar and a crank stopper portion of the hinge for controlling the stress of the torsion bar.

Briefly described, in accordance with the present invention, an electrophotographic copying machine is of the type including a housing separated into an upper body and a lower body. A hinge structure of the housing comprises a torsion bar for offering the torsion moment in a single direction, and a spacer interposed between a crank portion of the torsion bar and a crank stopper of the hinge structure. The spacer, preferably, a wedge like member, is provided for controlling the space between the crank and the crank stopper. The stress of the torsion bar is controlled so that the force of lifting the upper body can be uniformed for each copying machine. A moving member is further provided for moving the spacer between the crank portion of the torsion bar and the crank stopper of the hinge.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
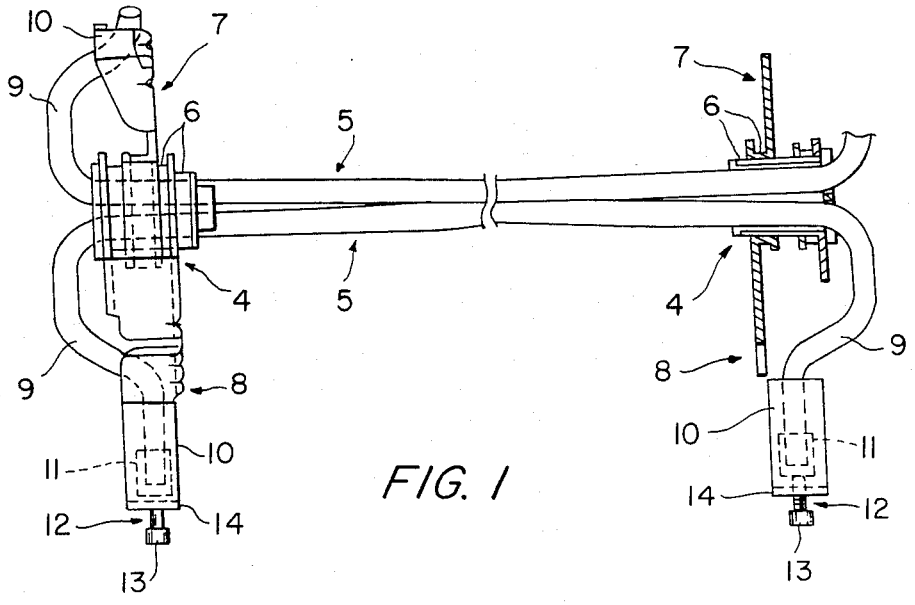
FIG. 1 is a side view of a hinge structure with a torsion bar for an electrophotographic copying machine according to a preferred embodiment of the present invention.

FIG. 1 shows a side view of a hinge structure for an electrophotographic copying machine according to a preferred embodiment of the present invention.

Figure 2:
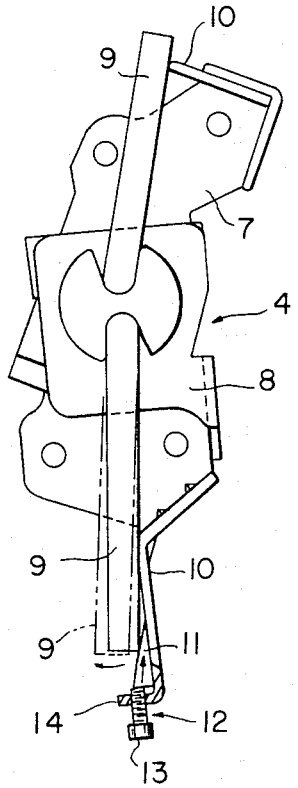
FIG. 2 shows another side view of the hinge structure of the copying machine of FIG. 1.

FIG. 2 is another side view of the hinge structure of FIG. 1.

Figure 3:
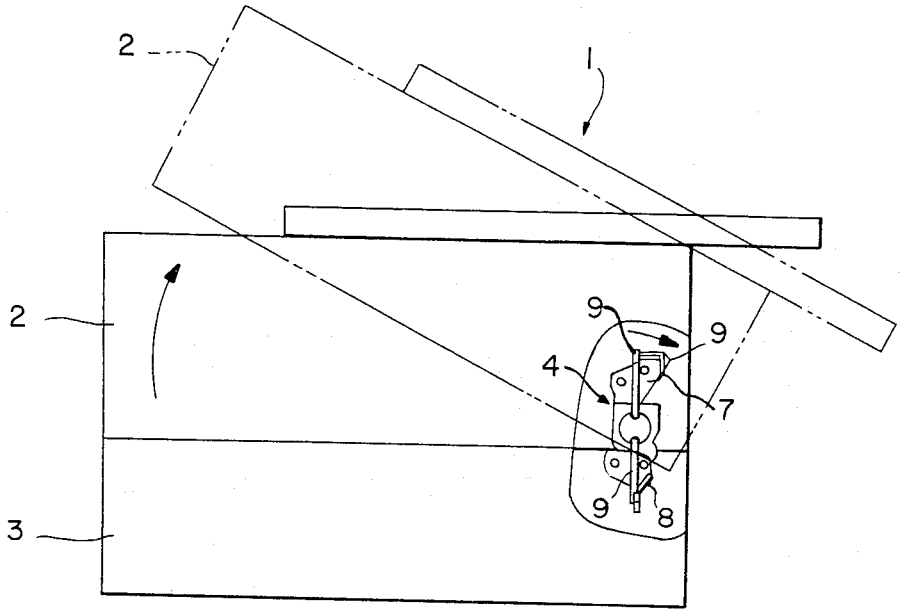
FIG. 3 is a side view of the copying machine to which the present invention is embodied with a spacer and a spacer movement means of the present invention being both omitted from illustration.

FIG. 3 is a side view of the copying machine to which the hinge structure of the present invention is embodied with a spacer and a spacer movement means of the present invention being both omitted from illustration.

As shown in FIG. 3, an electrophotographic copying machine 1 comprises an upper body 2 and a lower body 3 separated from each other along a path of a copy paper in order to facilitate the removal of a jammed copy paper. The upper body 2 accommodates heavy parts of the copying machine while the lower body 3 accommodates the other parts of the copying machine. A hinge 4 is provided for lifting the upper body 2. A torsion bar 5 is provided for offering the torsion moment in a single direction to activate the hinge 4. The hinge 4 is a metal and comprises an upper metal 7 and a lower metal 8 whose cylindrical bearings 6 are rotatably combined to each other. Preferably, each of a pair of hinge metals 4 is provided at each side of the copying machine. The upper metal 7 of the hinge metal 4 is mechanically connected to the upper body 2 while the lower metal 8 of the hinge 4 is mechanically connected to the lower body 3. A pair of torsion bars 5 are inserted into the cylindrical bearings 6 of the pair of hinge metals 4 such that each crank portion 9 of the torsion bar 5 rests against each crank stopper 10 of the upper metal 7 and the lower metal 8. The hinge metal 4 is stressed toward the direction of lifting the upper body 2 upward as indicated by the arrow of FIG. 3.

According to the present invention, the hinge metal 4 is provided with a spacer 11, preferably, a metal of a wedge type, and a spacer moving member 12 such as a screw. The spacer 11 moves along the gap between the crank 9 and the crank stopper 10 of the lower metal 8 according to the force by the moving member 12. Therefore, the tip of the wedge spacer 11 can be inserted between the crank 9 of the torsion bar 5 and the crank stopper 10 of the lower metal 8. Preferably, the moving member 12 comprises a thumbscrew 13. The shaft of the thumbscrew 13 is screwed into a hole formed on a bent arm 14 right from the crank stopper 10 of the lower metal 8 and the tip of the thumbscrew 13 is in contact with the rear of the spacer 11.

After the hinge structure with the torsion bars 4 of the present invention is assembled with being interposed between the upper body 2 and the lower body 3 of the copying machine 1, the thumbscrew 13 of the spacer moving member 12 is rotated so that the tip of the spacer 11 is inserted between the crank portion 9 and the crank stopper 10 of the lower metal 8 to widen the gap between the crank portion 9 and the crank stopper 10, thereby increasing the torsion moment of the torsion bar 5.

As described above, according to the present invention, the hinge structure with the torsion bars 5 is such that the spacer 11 can be shifted with the movement of the thumbscrew 12 to control the force of the torsion bars 5 for each machine. Thus, the force of lifting the upper body 2 can be uniformed for each machine. There may be no fear that the upper body 2 leaps up with too much force of the torsion bars 5 and, further, it is difficult to separate the upper body 2 owing to too little force of the torsion bars 5. As shown in FIG. 1, since each spacer 11 is provided for each torsion bar 5 at the opposing sides, the force of the two torsion bars 5 can be independently adjusted, thereby preventing the force at the light side and the left side of the copying machine from being unbalanced to thereby overload the bearings 6 of the hinges 4.

Although each of the pair of spacers 11 is disposed under each of the crank portions 10 of the lower metals 8 in the two hinge metals 4 in the above description, it may be possible to provide a single spacer near the crank portion of a single torsion bar if the only single torsion bar is provided. Further, the spacers may be provided near the crank stopper 10 of each of the upper metal 7 and the lower metal 8 of each of the two hinges 4. The spacers 11 can pull the bottom of the spacers 11 in, but cannot pull it out. Of course, it can pull the tips of the spacers 11 in and out by providing a screw hole at the tip of the thumbscrew 12 forcing the bottom of the spacer 11. It is unnecessary that the spacer moving member 13 comprises the thumbscrew 12 as shown. Any other members can be adopted.

While only certain embodiments of the present invention have been described, it will be apparent to those skilled in the art that various changes and modifications may be made therein without departing from the spirit and scope of the present invention as claimed.

What is claimed is:

1. An electrophotographic copying machine comprising:

first body means accommodating parts of the electrophotographic copying machine;

second body means accommodating the other parts of the copying machine;

torsion bar means for stressing said first body means in a predetermined direction; and adjustment means provided for controlling the stressing force of said torsion bar means.

2. The machine of claim 1, wherein said torsion bar comprises crank means, crank stopper means, and spacer means interposed between said crank means and said crank stopper means for controlling the force of said torsion bar means.

3. The machine of claim 2, wherein said spacer means is a wedge.

4. The machine of claim 2, further comprising means for forcing said spacer means toward the gap between said crank means and said crank stopper means.

5. The machine of claim 1, wherein said torsion bar means is provided at both sides of the copying machine.

* * * * *